United States Patent [19]

DePenti

[11] 3,972,421

[45] Aug. 3, 1976

[54] CAR COUPLER

[75] Inventor: Kenneth L. DePenti, Mayfield Heights, Ohio

[73] Assignee: Midland-Ross Corporation, Cleveland, Ohio

[22] Filed: Apr. 18, 1975

[21] Appl. No.: 569,444

[52] U.S. Cl. ..... 213/127; 213/146

[51] Int. Cl.[2] ..... B61G 3/06

[58] Field of Search ..... 213/127, 144–148

[56] References Cited

UNITED STATES PATENTS 3,433,369 3/1969 Metzger et al. ..... 213/148

*Primary Examiner*—Robert B. Reeves
*Assistant Examiner*—John P. Shannon
*Attorney, Agent, or Firm*—Henry Kozak

[57] ABSTRACT

A knuckle type railway car coupler is provided with an improved lock within the coupler head to assure that during a knuckle closing operation the coupler lock will drop from an upper unlocking position to full locking position relative to the knuckle.

1 Claim, 11 Drawing Figures

FIG.1
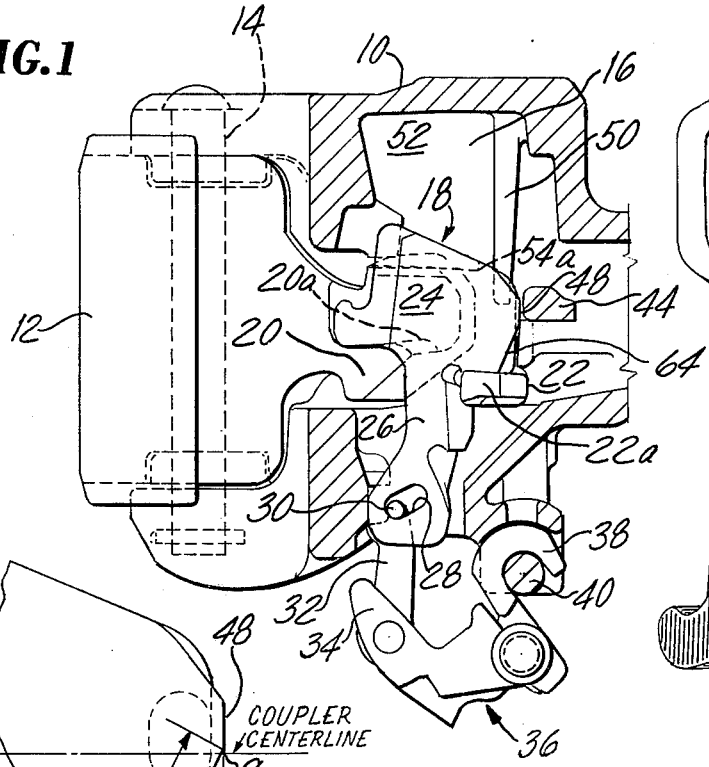
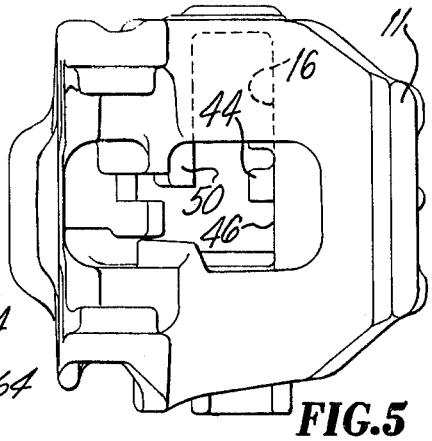
FIG.5
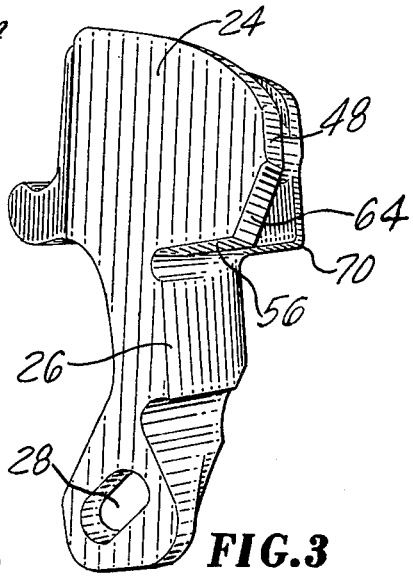
FIG.3
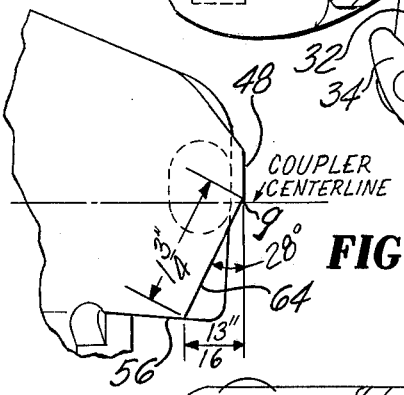
FIG.4
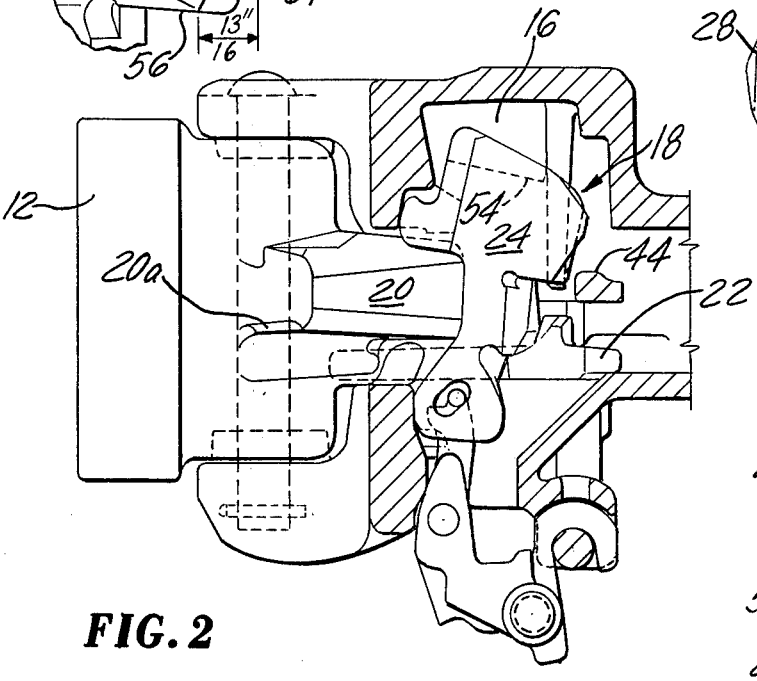
FIG. 2
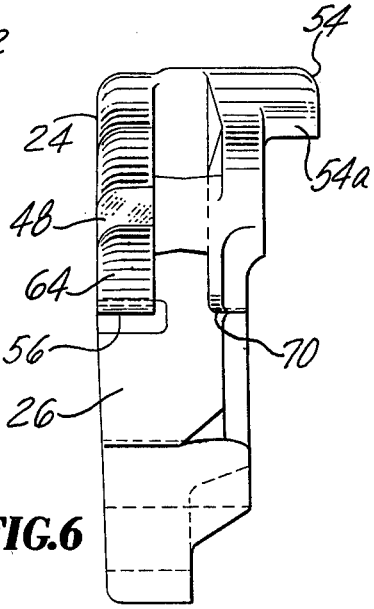
FIG.6

CAR COUPLER

BACKGROUND OF THE INVENTION

The standard E coupler has been in use on the railroads for over 40 years and has performed very satisfactorily during this period. An essential requirement of a railway car coupler is that upon completion of a coupling operation, the knuckles of the coupled couplers must be locked in closed position so as to avoid a train parting. In the standard E coupler, the coupler head is provided with stop means intended to guide the lock as it drops by gravity to its locking position during a knuckle closing operation. However, due to the very irregular configuration of the lock, the lock chamber in the coupler head and the knuckle, the lock under certain coupling conditions may fail to drop to its full locking position. Instead of dropping, the lock may be hung-up on the stop means and be prevented from moving to its normal locking relation with the closed knuckle. In its hung-up position, the rear lower end of the lock body may rest on the stop means disposed within the lock chamber on the guard arm side of the coupler and thereby retain the lock out of locking relationship with the knuckle, and, although the knuckle is closed, it remains unlocked. The present invention is concerned with providing a lock configuration whereby the lock, when applied to the present standard E coupler, will avoid the aforementioned hang-up of the lock and assure dropping thereof to full locking position upon closing of the knuckle, as during a coupling operation.

SUMMARY OF THE INVENTION

The invention resides in the provision of a bevelled surface of substantial extent at the rear side of the lock body, which surface serves to slide against stop means in the coupler head during dropping of the lock from its elevated unlocking position, thereby avoiding the possibility of a hang-up of the lock on the stop means. Within the lock chamber of the head of a standard E coupler, on the guard arm side thereof, is a lug which functions to retain the lock against movement rearwardly of the coupler when in locked position and also serves to guide the lock during a portion of its vertical movements. The bevelled surface on the lock is so arranged that as the coupler knuckle is closed, this surface is in overlying relation to the lug, and as the lock drops, the surface engages the lug and slides therealong to allow unhindered dropping of the lock to its locking position.

The various features and advantages of the invention will be set forth in the following description taken in conjunction with the drawings.

BRIEF DESCRIPTION OF THE DRAWING

FIG. 1 is a longitudinal vertical sectional view of a railway car coupler embodying the invention showing the coupler in locked condition.

FIG. 2 is a longitudinal vertical sectional view of the coupler shown in FIG. 1, the knuckle being in open position with the lock support on the knuckle tail.

FIG. 3 is a perspective view of a coupler lock embodying the invention.

FIG. 4 is a fragmentary side elevational view of the coupler lock shown in FIG. 3.

FIG. 5 is a front elevational view of the coupler head shown in FIGS. 1 and 2 with the knuckle removed.

FIG. 6 is rear elevational view of the coupler lock shown in FIG. 3.

DESCRIPTION OF THE PREFERRED EMBODIMENT

Figure 7:
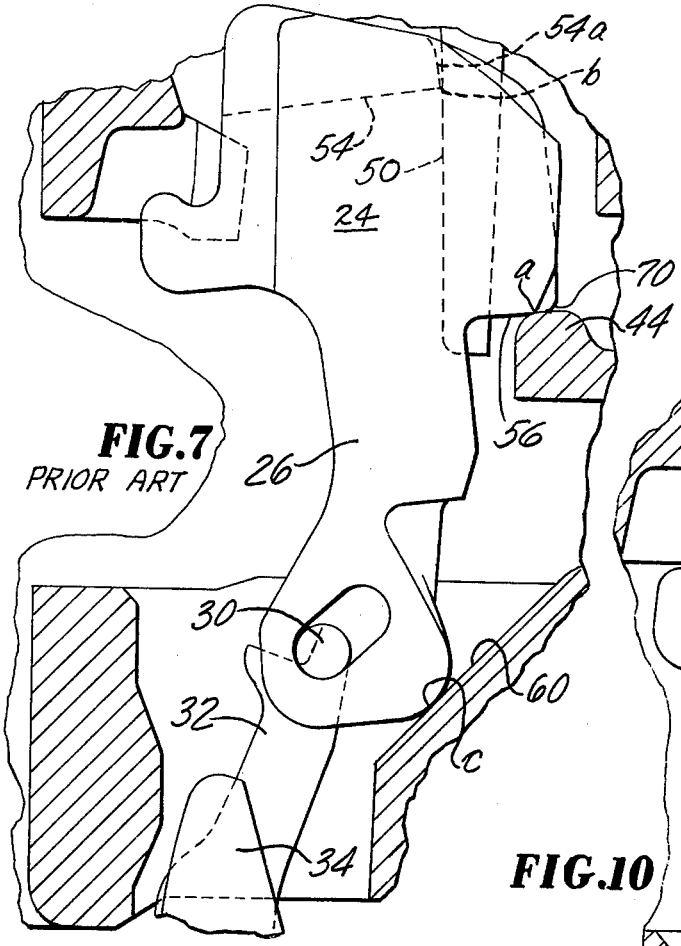
FIG.7 PRIOR ART
FIG. 7 is an enlarged fragmentary view in vertical section of a coupler showing a lock not embodying the invention, the lock being in a hung-up position.

The invention has been embodied in a standard E coupler which has a head 10 having a guard arm 11 on one side thereof and a knuckle 12 pivotally connected thereto at the other side thereof by a vertical pivot pin 14. Head 10 has a lock receiving chamber 16. A lock 18 is disposed in chamber 16 and in closed position of the knuckle the lock is in its lowermost or locking position as seen in FIG. 1 and is interposed between one side of the knuckle tail 20 and the adjacent sidewall 46 on the guard arm side of the coupler head. Lock 18 in its locking position is supported partly on a support ledge 20*a* of the knuckle tail and partly on arm 22*a* of knuckle thrower 22, as is well known in the art. The lock comprises an upper body portion 24 and a depending leg portion 26. A diagonally extending slot 28 is provided in the lower end of lock leg 26 for receiving a horizontal trunnion 30 at the upper end of lock lifter link 32 for operatively connecting the leg and lock. The lower end of link 32 is pivotally connected to the forwardly extending portion 34 of rotor lever 36. Lever 36 has a hook-shaped portion 38 which is supported on a horizontal trunnion 40 on the underside of the coupler head for pivotal mounting of the lever. Lever 36 is actuated by the usual uncoupling rod (not shown) to effect raising of the lock out of its locking relation with knuckle tail 20 to permit the knuckle to be swung to open position.

In FIG. 2 knuckle 12 is shown in fully open position and lock 18 is in the upper end of chamber 16, its body portion 24 resting on top of knuckle tail 20. Upon closing of the knuckle, the lock will drop by gravity to lock the knuckle, as shown in FIG. 1. The lock when in locking position is retained against rearward displacement by lug 44 which projects laterally into lock chamber 16 from the side wall 46 of the coupler head on the guard arm side of the coupler and is directly rearward of a portion of lock body 24. It will be seen from FIG. 1 that lug 44 is in opposed relationship with the vertical rearward surface 48 of the lock body. Another lug in the form of a vertically extending lock guide rib 50 extends into chamber 16 from the side wall 52 on the knuckle side of the coupler head. Rib 50 extends downwardly from the top wall of the head to about a point midway between the top and bottom of lug 44. Also, rib 50 has an inwardly facing surface 50a which is disposed adjacent the side of lock body 24, in close proximity thereto, to limit lateral displacement of the lock during its vertical travel. Lock 18 at its upper end on the knuckle side of the coupler has a laterally extending lug 54 the rearward surface 54a of which is adapted to engage forward side of rib 50 to limit rearward tilting of the lock during its vertical movement during unlocking and locking of the coupler. In the locked position of the knuckle, lug surface 54*a* is spaced forwardly of rib 50 a substantial amount.

It has been found that the existing lock for the standard E coupler may, during closing of the knuckle, hang-up as shown in FIG. 7, instead of dropping to its locking position (FIG. 1). In the "hung-up" position illustrated, the lock is engaged with the coupler head at points "*a*", "*b*" and "*c*". It is possible for the lock to hang-up because its body 24 has a flat, substantially horizontal shoulder portion 56 at the bottom thereof which is of sufficient rearward extent that, upon closing of the knuckle, it may be caused to rest on lug 44 as at *a*. Simultaneously contact as at *b*, between surface 54*a* and rib 50, and at *c*, between lock leg 26 and sloping surface 60 in the coupler head may occur. It will be appreciated that with the lock in its hung-up position a mis-coupling results. Thus, while the coupler knuckle was closed during the intended coupling of a pair of cars, it was not locked, and a parting of the cars will occur when a pulling force is applied thereto.

Figure 8:
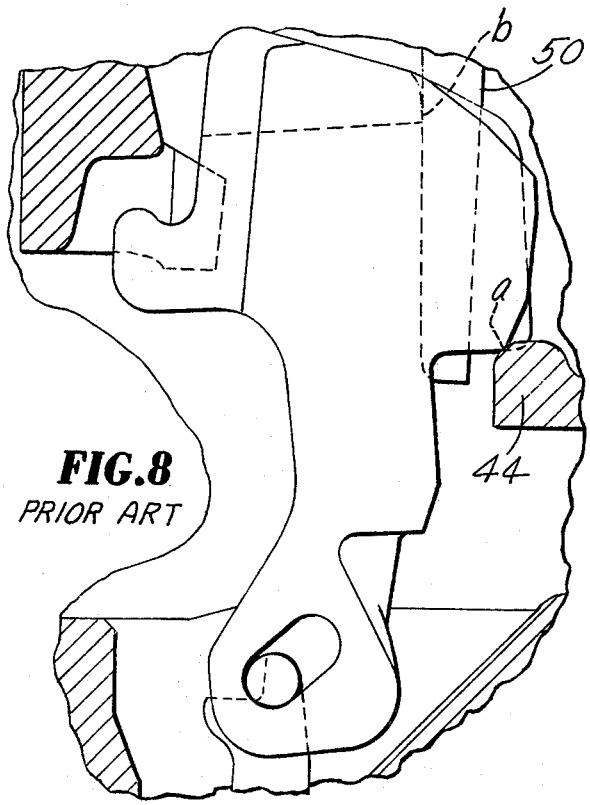
FIG.8 PRIOR ART
FIG. 8 is a view similar to FIG. 7 but showing the coupler lock in another hung-up position.

Referring now to FIG. 8, this view shows another position in which the lock may hang-up during a coupling operation. In this position, contact occurs at *a* and at *b*, but not at *c*. However, in either the FIG. 7 or FIG. 8 positions the lock has failed to drop to its locking position relative to the knuckle.

Figure 10:
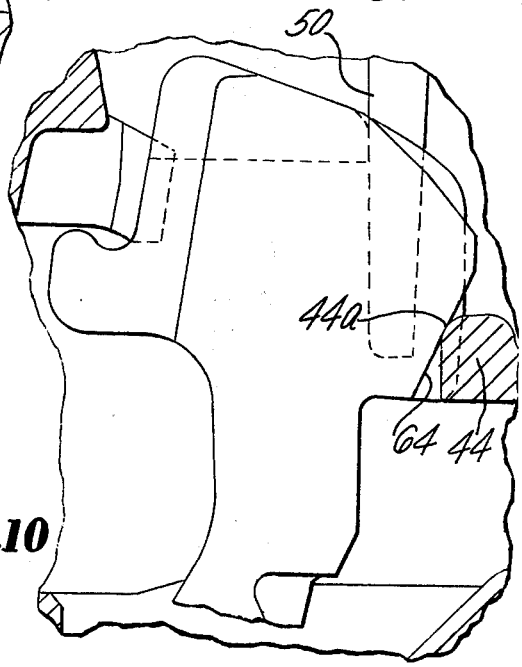
FIG. 10 is a view similar to FIG. 9 but showing the lock in a lower position in the coupler head as it drops toward locking position.
Figure 9:
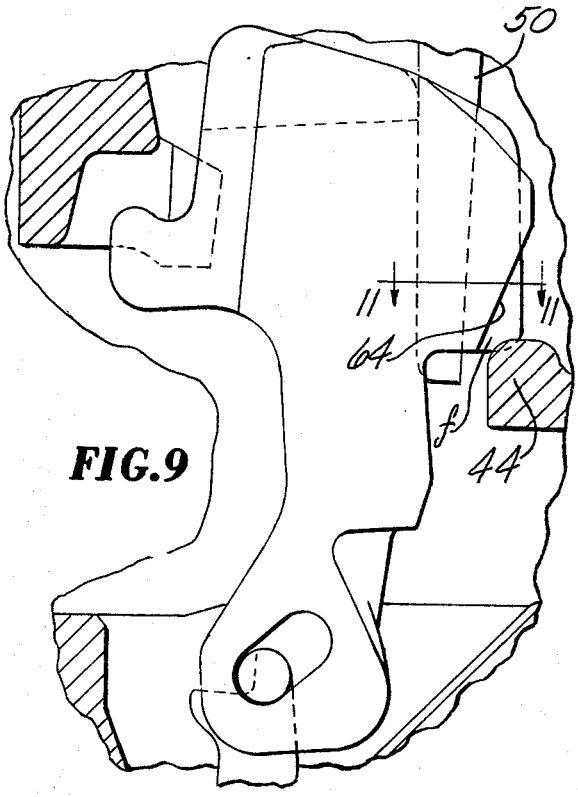
FIG. 9 is a fragmentary view in vertical section showing a lock embodying the invention, the lock being in the same relative position in the coupler head as in FIG. 8.

The improved lock embodying the invention is formed with a bevelled flat rear surface 64 of substantial length on the rear side of the lock extending from the lower edge of vertical surface 48 downwardly and forwardly to the bottom of lock body 24 and being in opposed relation to lug 44. Surface 64 as thus arranged on the lock avoids the hang-up of the lock as shown in FIGS. 7 and 8. Referring to FIG. 9 which shows the improved lock in the same relative position in the coupler head as the lock in FIG. 8, it will be seen that a substantial clearance as at "*f*" exists between bevelled surface 64 and lug 44. Thus, the contact as at *a* in FIG. 8 has been completely avoided. Since the only contact now existing between the lock and the coupler head is between lug 54 and rib 50, the lock is, therefore, free to drop toward locking position. FIG. 10 shows the lock after it has dropped substantially further toward locking position, with surface 64 sliding along the rounded upper corner 44*a* of lug 44. This sliding continues until the lock drops to its locking position as shown in FIG. 1.

Referring particularly to FIG. 4 which shows the details of the arrangement of bevelled surface 64, it will be noted that this surface makes an angle of about 28° with vertical surface 48. This slope will avoid hang-up of the lock as it drops to locking position upon closing of the knuckle. Also, it will be observed that bevelled surface 64 at its upper end commences at the intersection of vertical surface 48 with the horizontal plane containing the longitudinal centerline of the coupler as at "*g*". Surface 64 is approximately 1-¾ inches in length and its lower end intersects shoulder 56 at about 13/16 inches forwardly of vertical surface 48. Moreover, bevelled surface 64 is at least about 2-½ times the length of vertical surface 48.

While surface 64 has been shown as being flat, it will be appreciated that this surface if curved slightly, either convexly or concavely along a radius of at least about 6 inches or larger, will be satisfactory in avoiding the hang-up of the lock as shown in FIGS. 7 and 8.

Figure 11:
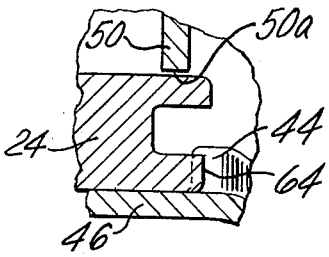
FIG. 11 is a horizontal sectional view taken along line 11—11 of FIG. 9.

While in FIG. 7 it appears that lower rear corner portion 70 of the lock rests on lug 44, this is not the case. Portion 70 is on the opposite side of the lock from shoulder 56, as is clear from FIGS. 3 and 6. It will be understood that lug 44 extends inwardly from sidewall 46 of the coupler head a small distance so that it overlaps only surfaces 48 and 64. The inward extent of lug 44 may be seen in FIGS. 5 and 11.

The invention has been shown applied to a standard E coupler but it will be understood that the benefits of the improved lock will also be obtained if it is used in other similar knuckle type couplers.

What is claimed is:

1. In a standard E car coupler a head having a lock receiving chamber, said head having a guard arm on one side thereof and knuckle pivoted to the other side thereof, said knuckle being movable from closed to open position, a lock in said chamber comprising an upper body portion, said lock having a locking position relative to said knuckle to hold the latter in closed position and being movable upwardly in said chamber to unlocking position relative to the knuckle, said lock being adapted to drop by gravity from said unlocking position to said locking position when said knuckle is swung to closed position, a vertically extending guide rib in said chamber disposed on the knuckle side of said head, said lock body portion having on one side thereof at its upper end a laterally extending lug the rear surface of which is adapted to engage said rib to guide the lock and limit rearward tilting thereof during downward movement of the latter toward said locking position, lug means in said head on the guard arm side thereof extending laterally into said chamber and disposed directly rearward of said lock body portion when the lock is in said locking position, said lock body portion having a vertical rear surface adapted to engage said lug means to limit rearward displacement of the lock when in said locking position, and said lock body portion having a bevelled rear surface of substantial length commencing at the lower edge of said vertical surface and extending downwardly and forwardly to the bottom of said body portion, said bevelled surface being so arranged that, upon dropping of said lock from said unlocking position during closing of the knuckle, the lower end of said bevelled surface is always disposed forwardly of said lug means so that as the lock drops said bevelled surface makes sliding contact with said lug means to permit dropping of the lock to said locking position.

* * * * *